US006217825B1

(12) United States Patent
Brückner et al.

(10) Patent No.: US 6,217,825 B1
(45) Date of Patent: Apr. 17, 2001

(54) DEVICE AND FIREPROOF NOZZLE FOR THE INJECTION AND/OR CASTING OF LIQUID METALS

(75) Inventors: Raimund Brückner, Wiesbaden; Daniel Grimm, Bad Schwalbach, both of (DE)

(73) Assignee: Dider Werke AG, Wiesbaden (DE)

( * ) Notice: Subject to any disclaimer, the term of this patent is extended or adjusted under 35 U.S.C. 154(b) by 0 days.

(21) Appl. No.: 09/230,922

(22) PCT Filed: Jul. 11, 1997

(86) PCT No.: PCT/DE97/03695

§ 371 Date: Feb. 3, 1999

§ 102(e) Date: Feb. 3, 1999

(87) PCT Pub. No.: WO98/05452

PCT Pub. Date: Feb. 12, 1998

(30) Foreign Application Priority Data

Aug. 3, 1996 (DE) ..... 196 31 489
Dec. 11, 1996 (DE) ..... 196 51 534

(51) Int. Cl.[7] ..... B22D 37/00

(52) U.S. Cl. ..... 266/237; 266/241; 222/590; 222/593

(58) Field of Search ..... 75/10.14, 10.15, 75/584; 266/237, 241; 222/590, 593

(56) References Cited

U.S. PATENT DOCUMENTS

| | | | | |
|---|---|---|---|---|
| 4,515,203 | | 5/1985 | Narita et al. | 164/468 |
| 4,655,237 | | 4/1987 | Gloor et al. | 137/13 |
| 4,842,170 | * | 6/1989 | Del Vecchio et al. | 266/237 |
| 5,074,532 | * | 12/1991 | Ducrocq et al. | 266/237 |

FOREIGN PATENT DOCUMENTS

| | | | | |
|---|---|---|---|---|
| 973357 | * | 8/1975 | (CA) | 266/237 |
| 1049547 | | 1/1959 | (DE) . | |
| 1912760 | | 10/1970 | (DE) . | |
| 2433582 | * | 7/1974 | (DE) . | |
| 3113192 | | 2/1982 | (DE) . | |
| 4136066 | | 5/1993 | (DE) . | |
| 4428297 | | 2/1996 | (DE) . | |
| 19500012 | | 7/1996 | (DE) . | |
| 0155575 | | 9/1985 | (EP) . | |

OTHER PUBLICATIONS

K. H. Spitzer et al., Multi–frequency electromagnetic stirring of liquid metals, *ISIJ International*, vol.36, No. 5, 1996, pp. 487–492. No month.

Klaus Schwertferger, "Metallurgie des Stranggiessens", verlag Stahleisen, *Düsseldorf*, 1992, pp. 449–471. No month.

The American Hertigage Dictionary of the English Language, 3rd Ed. 1992 by Houghton Mifflin Company.*

* cited by examiner

*Primary Examiner*—Roy King
*Assistant Examiner*—Tina McGuthry-Banks
(74) *Attorney, Agent, or Firm*—Wenderoth, Lind & Ponack, L.L.P.

(57) ABSTRACT

In a process for splashing and/or teeming liquid metal, in particular steel, through a discharge in the wall or in the bottom of a metallurgical vessel, the discharge is electromagnetically coupled to the electromagnetic field of at least one fluid-cooled, in particular air-cooled, inductor. The inductor and the discharge are at least partially disposed in the wall or in the bottom of the metallurgical vessel. For teeming, the electromagnetic field of the inductor, or of the inductors, is coupled directly to the discharge and also the liquid metal. For this purpose, the frequency of the electromagnetic field or the electromagnetic fields, if appropriate, is adjusted correspondingly.

61 Claims, 3 Drawing Sheets

DEVICE AND FIREPROOF NOZZLE FOR THE INJECTION AND/OR CASTING OF LIQUID METALS

This application is a national stage of PCT/EP97/03695, filed Jul. 11, 1997.

BACKGROUND OF THE INVENTION

The invention relates to a process for splashing and/or teeming of liquid metals, in particular steel, through a discharge in the wall or in the bottom of a metallurgical vessel, wherein the discharge is electromagnetically coupled to the electromagnetic field of at least one fluid-cooled inductor. The inductor and the discharge are disposed at least partially in the wall or in the bottom of the metallurgical vessel. Following splashing, the electric power of the inductor or the inductors, if appropriate, is changeable.

Such process for an inductor is disclosed in De 44 28 297 A1 in a free-running nozzle. In DE 41 36 066 A1 a discharge device for a metallurgical vessel is described, in which a cooled inductor is disposed outside of the bottom of a vessel. In DE-A-24 33 582 an arrangement for the production of cast parts is disclosed, wherein several inductors, disposed one next to the other and switchable independently of one another, are provided and which are cooled either with water or with air. DE-AS 1 049 547 discloses an arrangement for the electrically controlled teeming of metals. Below, and thus outside, of the bottom of a metallurgical vessel three coils are disposed as inductors laterally of a discharge. The coils are intended to generate in the steel column an alternating traveling field advancing from below toward the top, through which in the steel column, i.e. the outflowing melt, an upwardly directed force component is generated, which, depending on the field strength, can decelerate or cancel the outflowing of the liquid steel. The metal column, rigid at the beginning of casting, can be inductively melted by the alternating field. In the technical work "Metallurgie des Stranggießens", {metallurgy of continuous casting}, Editor: K. Schwerdtfeger, Publisher: Stahl-Eisen, Dusseldorf, 1992, pp. 449, electromagnetic agitation during continuous casting and associated inductors are explained. Agitators are always disposed within the region of the strand-forming chill or, in the direction of flow of the strand, behind it. A regulation and closing device for a metallurgical vessel with a rotor and a stator (pipe-in-pipe closing system) is described in DE 195 00 012 A1. Depending on the selection of the material for the rotor, either the rotor itself or the melt flowing through it is coupled to the electromagnetic field of an inductor.

In the case of horizontal continuous casting machines, the pouring discharge or pouring discharges mount into a side wall of the melt vessel. The pouring discharge or pouring discharges is/are flanged onto a chill such that the melt flows horizontally through the pouring discharge, or the pouring discharges, into the chill. According to prior art, the pouring discharges before splashing are heated with a gas burner in order to prevent the freezing of the melt already during splashing. Carrying out this preheating is problematic since it cannot be maintained during the preparatory mounting processes and thus the temperature of the pouring discharge decreases, leading to the pouring discharge being frozen closed during splashing. In the case of horizontal continuous casting machines, by necessity a specific temperature gradient is set up in the liquid metal in a distributor. In the liquid metal flowing through the pouring discharges, this leads to so-called temperature streaks or "black strips" and thus to a quality of reduction the cast strand.

SUMMARY OF THE INVENTION

It is an object of the invention to provide a process of the above type for the improvement of splashing and/or teeming. It is furthermore an object of the invention to provide a refractory discharge suitable for this purpose and a suitable arrangement or assembly incorporating such discharge.

According to the invention the above objects are achieved by provision of an air-cooled inductor for use according to the invention in the bottom or the wall of a metallurgical vessel. Through the inductive heating of a discharge during splashing it is attained that during splashing the discharge or the pouring discharge does not receive thermal shock fractures and that the metal melt entering it does not freeze and even, in case an interruption occurs in casting, does not freeze or metal frozen in it melts again. The heating of the discharge or of the pouring discharge by means of at least one inductor is made possible by use therefor at least partially of a material capable of being coupled to the electromagnetic field of the inductor. The pouring discharge of an inductively coupling material can also entirely or partially comprise in its passage an inner layer of a non-inductively coupling, wear-resistant material which is heated by thermal conduction and/or heat radiation. When using a pouring discharge of a non-coupling material, it is encompassed by a susceptor coupled to the electromagnetic field which outputs to the pouring discharge thermal energy through thermal conduction and/or heat radiation.

After splashing, thus for teeming, the frequency of the electromagnetic field of the inductor or of the inductors can be adjusted in such a way that the field penetrates the pouring discharge and, if appropriate, also the susceptor and now also couples electromagnetically at least the outer layer of the liquid metal itself to the field. Thus, a temperature effect of the steel flowing through the pouring discharge becomes more effective. If appropriate, the liquid metal strand in the region of the discharge is coupled to a further electromagnetic filed which does not primarily serve for heating but rather has different functions, for example, an agitating function. It is thus coupled for the purpose of splashing, as long as no liquid metal flows through the discharge, to it alone and does so with optimum power and frequency for an adjustment in time of the desired temperature of the discharge. For teeming, the frequency and, if necessary, also the power of the inductor is adjusted such that the liquid metal flowing through the discharge is also exposed to the electromagnetic field. The power can normally be reduced until the customary temperature losses in the discharge system are compensated. However, it is also possible, in particular toward the end of teeming, to avoid freezing of liquid metal in the pouring discharge. Thereby, the discharge and/or the liquid metal flowing through the discharge, is inductively heated by means of the inductor, for the purpose of which the power of the inductor is successively increased. The potentially existing necessity of power matching depends on the inducting thermal energy, desired for reasons of process engineering, for heating or the desired movement in the steel flowing through the discharge for the purpose of making the temperature uniform.

As indicated earlier, spatially changeable magnetic fields can be generated in the liquid metal, and lead to motion in the liquid metal flowing through the pouring discharge. Such magnetic fields are realized as rotary and/or linear traveling fields which generate in the liquid metal in the discharge an agitation effect, similar to that described in the earlier cited technical work, resulting in the temperature in the through-flow cross section of the liquid metal becoming uniform such that temperature streaks do not occur in the steel during its entrance into the chill. Thereby, "black stripes" are avoided, leading to a quality improvement of the strand. The frequencies and/or powers required for this purpose differ from those of heating inductors.

The process solves not only preheating problems or cooling problems existing before the melt outflow, but also temperature problems existing in the through-flowing melt itself. The process can readily be carried out since for this purpose only the electromagnetic field of the inductor or of the inductors, in particular only is frequency and power, must be adjusted accordingly. The process can be used especially advantageously in a horizontal continuous casting machine. However, it can also be used in other installations.

During splashing and/or teeming, operation takes place at a first frequency between 2 kHz and 20 kHz, preferably between 6 kHz and 10 kHz. Operation preferably takes place during teeming at a further or additional frequency, if appropriate in addition to the first frequency, between 3 Hz to 4000 Hz, preferably between 500 Hz to 3000 Hz. For this purpose spatially variable electromagnetic fields are preferably used for generating an agitating effect, as will be explained later. In a development of the invention, before and during splashing, operation takes places at an electric power of 5 kW to 150 kW, preferably 30 kW to 100 kW. During teeming, operation preferably takes place at a regulatable electric power between 3 kW and 120 kW, preferably 5 kW to 40 kW. Thus, during teeming in many cases a lower electric power suffices than during splashing, since potentially only temperature losses, for example through heat dissipation into the wall or the bottom of the metallurgical vessel or through heat radiation into the environment, must be compensated. Due to the regulatability of the electric power, adaptation to the particular temperature conditions in the melt is possible.

In a further development of the invention, an outflow of the discharge is closed before splashing by means of a control element, known per se, for example a pipe-in-pipe closing system or a gate valve, and the discharge, before filling the vessel with liquid metal, is heated by means of the inductor or one or several inductors, to a temperature at which the liquid metal within or in the region of the discharge does not freeze such that the liquid metal flows out when the control element is opened. During teeming the discharge, in spite of heat radiation and cooling of the metal in the metallurgical vessel, can be maintained or brought to temperatures which make difficult or prevent depositions of freezing melt or clogging.

If necessary, following filling of the vessel and of the discharge with liquid metal, the electric power and/or frequency of the inductor or one or several inductors is adjusted such that the electromagnetic field of the inductor or of one or several inductors not only becomes coupled to the discharge but also to the liquid metal. In this way, the metal is kept liquid in the discharge until the opening of the control element. Furthermore, by this measure a higher maximum energy can be introduced into the discharge/metal system.

A refractory, inductively heatable discharge to be disposed at least to some extent in the wall or in the bottom of a metallurgical vessel, in particular for liquid steel, for carrying out the above process is preheatable by means of at least one inductor, preferably air-cooled, also disposed in the wall or in the bottom of the metallurgical vessel. The wall thickness of the discharge and the frequency of the electromagnetic filed of the inductor are matched to each other such that the electromagnetic field substantially penetrates the discharge wall, thus, extends substantially through the entire wall thickness of the discharge wall, and that during teeming of the liquid steel, if appropriate, the electromagnetic field beyond the wall thickness of the discharge is also coupled to the liquid steel, whereby the maximum power consumption of the system can again be increased.

The refractory discharge comprises preferably an inductively couplable, in particular refractory, ceramic material. The discharge can comprise an inner layer which comprises a relatively wear-resistant, potentially not inductively couplable material, as is described in DE 44 28 297 A1. The refractory discharge is preferably a pouring discharge which can, for example, also be integrated with a immersion discharge, and which, if appropriate, can be set into a refractory sleeve which, if appropriate, comprises an inductor as a structural unit. The pouring discharge comprised of inductively couplable ceramic, is preferably produced of a carbon-bound material with a high alumina content, potentially with a wear-resistant inner layer or outer layer comprising, for example, zirconium oxide. To improve flow conditions, the pouring discharge can be widened in the shape of a diffuser in the inflow and/or outflow region. In particular in the outflow region, at least in horizontal continuous casting, widening is advantageous if the melt is poured in the near liquid state.

An arrangement or assembly for splashing and teeming of liquid metals, in particular steel, with a discharge which is disposed at least to some extent in the wall or in the bottom of a metallurgical vessel, and with at least to some extent in the wall or in the bottom of a metallurgical vessel, and with at least one inductor for carrying out the above process includes an inductor that is, at least to some extent, air-cooled and is provided with one or several fluid-cooled cooling circulations. The power and/or the frequency of the electromagnetic field of the inductor or of the inductors can be adjusted as a function of the casting conditions by at least one frequency changer or converter. It is therein conceivable that, for example, one inductor is water-cooled and the other is air-cooled, or that one inductor has water-cooling circulation and one has an air-cooling mechanism. The arrangement for splashing and/or teeming of liquid steel comprises preferably one inductor for generating electromagnetic rotary fields and/or linear traveling fields in the liquid steel strand in the region of the discharge. The rotary fields and/or the traveling fields can be disposed one behind the other in the direction of flow of the liquid metal or they can be superimposed. They serve for generating the above discussed agitation effect, in particular for making uniform the temperature of the metal strand in the discharge. A further inductor can serve for heating the discharge and the strand in the region of the discharge. The powers and/or frequencies of the particular inductors differ according to their purpose.

BRIEF DESCRIPTION OF THE DRAWINGS

Further advantageous features of the invention are described in the following description of embodiments thereof. In the drawings.

DETAILED DESCRIPTION OF THE INVENTION

Figure 1:
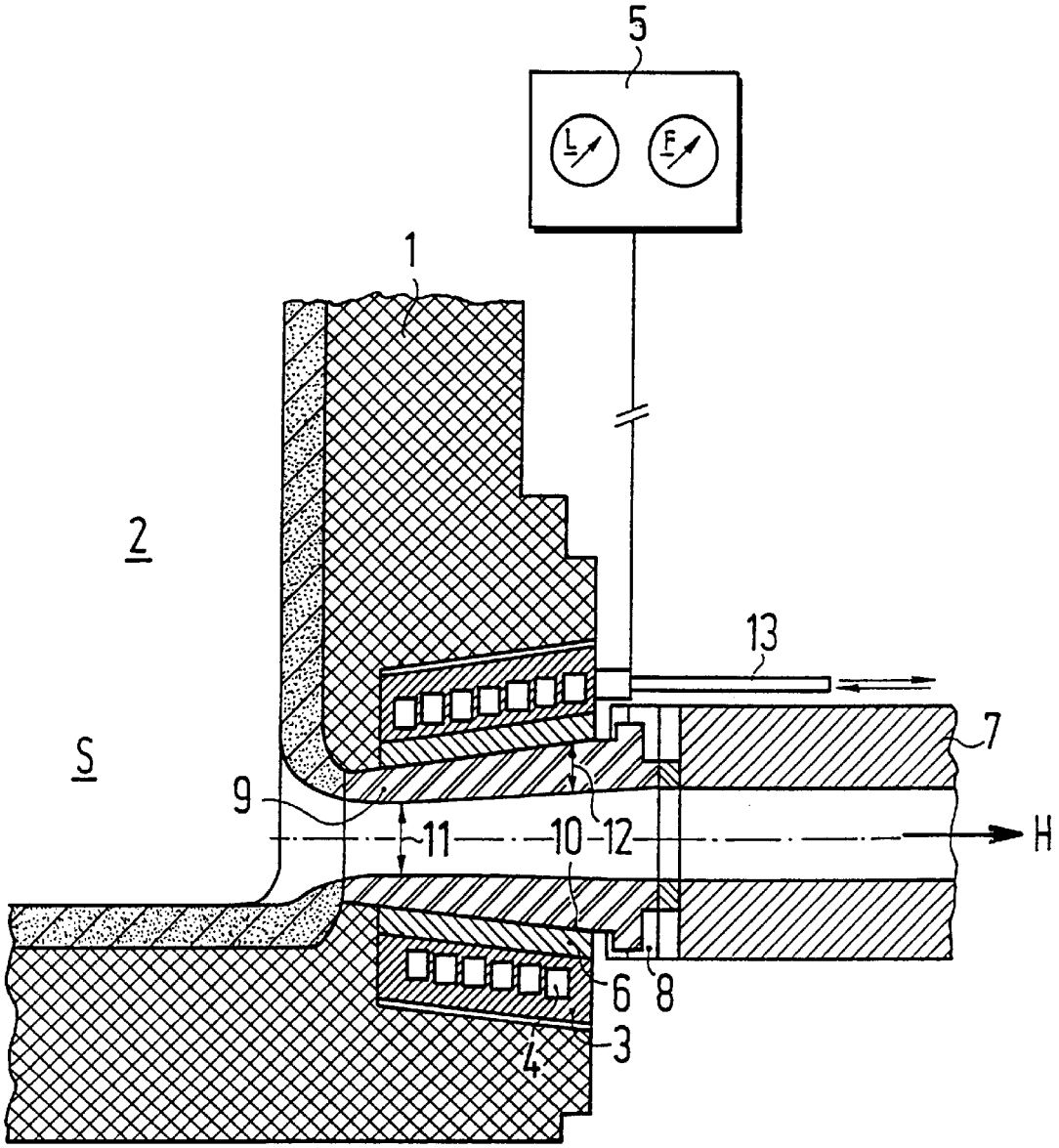
FIG. 1 is a sectional view of a discharge and an arrangement for splashing and teeming in a melt vessel with an attached chill supporting one or several pouring discharges of a horizontal continuous casting machine.
Figure 2:
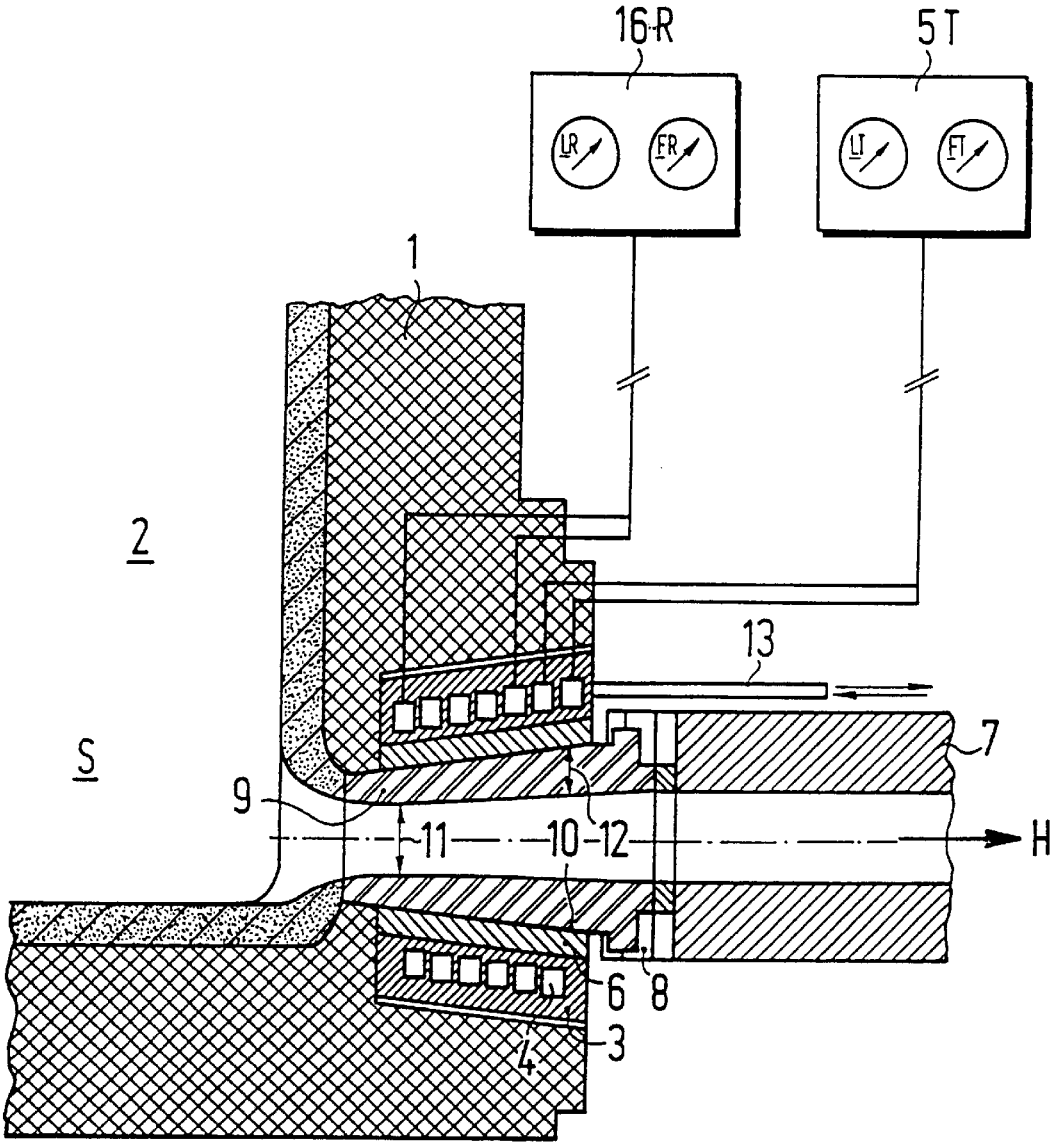
FIG. 2 is a corresponding view of a discharge, however with two separately controllable inductors.

According to FIGS. 1 and 2, in a side wall I of a vessel, specifically a metallurgical vessel, whose inner volume is denoted by 2, an inductor 4 is disposed in a refractory sleeve 3. The inductor 4 is cooled with air, at least to some extent, via pipe lines 13 and is electrically connected to a frequency changer of converter 5 whose frequency F and whose electric power L are adjustable. The inductor 4 is produced of a helically formed copper pipe. It is disposed about an intermediate sleeve 6 which serves for temperature insulation and for introducing pouring discharge 9, described in further detail below, into the opening of the side wall 1 of the vessel.

To a chill 7, associated with the vessel, is exchangeably flanged by means of a securing device 8 pouring discharge 9. In FIGS. 1 and 2 a pouring discharge is depicted. Further pouring discharges, flanged in the same way to the chill 7, are, if appropriate, disposed behind the plane of the drawing. In the representation according to FIGS. 1 and 2, pouring discharges 9, supported by the chill 7, are slid into the intermediate sleeve 6 by horizontal movements of the chill 7. A cement layer 10 serves for sealing between the pouring discharge 9 and intermediate sleeve 6. The pouring discharge 9, representing a wear part, comprises carbon-bound ceramic material containing alumina, which becomes inductively coupled to an electromagnetic field of inductor 4. The pouring discharge 9 forms a throughflow cross section 11 for steel melt flowing from the inner volume 2 of the vessel into the chill 7. The throughflow takes place in the horizontal direction H.

Operation is substantially as follows:

At the latest after the chill 7 with the pouring discharge(s) 7 is brought into the position shown in FIGS. 1 and 2 with the inner volume 2 of the vessel still empty, the inductor 4 is switched on by means of the changer or converter 5. By means of the frequency changer or converter 5, a frequency and an electric power are adjusted which, for the purposes of splashing, brings the pouring discharge 9 at least to a temperature, and maintains it at that temperature, at which the inflowing melt does not freeze. The inductive heating can also, and in particular further, be operated if a gas heating, potentially carried out in advance, of the vessel must be switched off the vessel is moved into the casting position in front of the chill. In the casting position, the metal melt S is filled into the inner volume 2 of the vessel. The melt flows through the pouring discharge 9 into the chill 7 from which it is drawn off as a solidified strand.

For heating the pouring discharge 9 before the splashing step, the frequency and/or the power of the electromagnetic filed of inductor 4 can be adjusted by means of the changer 5 to be higher than during a following teeming operation, described later. The frequency of the electromagnetic field is adjusted for the heating of the pouring discharge 9 such that the depth of penetration of the electromagnetic field covers substantially the wall thickness 12 of the pouring discharge 9. The electric power of the changer 5 is regulated according to a predetermined heating time. Before and during the splashing, the operation takes place at a frequency between 2 kHz and 10 kHz, preferably between 4 kHz and 10 kHz, and an electric power of 5 kW to 150 kW, preferably 20 kW to 60 kW. The depth of penetration of the electromagnetic field is to be 10 mm to 300 mm, preferably 10 mm to 40 mm, corresponding to the wall thickness 12 of the pouring discharge 9. After splashing, i.e. after the initial inflow of the melt through the discharge into the chill, and during subsequent teeming, the frequency of the changer 5, and thus that of the electromagnetic field of the inductor 4, is adjusted such that the electromagnetic field penetrates through the wall thickness 12 of the pouring discharge 9 into the metal melt flowing through the throughflow cross section 11. In the extreme case the penetration depth into the liquid steel can be up to approximately 100 mm. Conventionally operation takes place at a frequency between 6 kHz and 10 kHz. During teeming, apart from the conventional heating frequency, operation can take place with a further frequency between 3 Hz and 4000 Hz, preferably between 500 Hz and 3000 Hz in order to make uniform the temperature of the molten steel in the discharge. During teeming the electric heating power can be reduced. In this case it is between 3 kW and 120 kW, preferably between 5 kW and 40 kW. By adjusting the electric power before and during splashing, the temperature of the pouring discharge 9, and during teeming also the temperature of the through-flowing melt, can be influenced with a power increase causing in each instance a temperature increase.

In the event of a casting interruption, metal, possibly rigidified in the pouring discharge 9, can be rendered molten again and the strand again can be started. Through the specific inductive coupling of the through-flowing melt to the field of inductor 4, it is not only attained that the temperature of the melt can be effected. Through such inductive coupling, eddy currents are generated in the melt, which move the through-flowing metal melt in the throughflow cross section 11, such that substantially a uniform temperature distribution is present in the melt in the throughflow cross section 11. Thus, no temperature gradient occurs in the flowing metal melt, or temperature variations in the through-flowing metal melt from a temperature gradient in the distributor are compensated. This agitation effect can be improved since by means of inductor 4, or several inductors, a spatially changing magnetic field, for example, a rotary field and/or traveling field, is generated in the melt within the throughflow cross section 11. For this purpose the inductor 4 or the inductors are driven correspondingly by the changer 5 or several changers. Through such agitation metallic and/or nonmetallic depositions in the discharge or in the region of the discharge can also be prevented or eliminated. FIG. 2 shows an example of two inductors separately drivable by changers 5 and 16.

Toward the end of teeming, i.e. after the inner volume 2 of vessel 1 gradually empties, the frequency and/or the power of changer 5, and thus of inductor 4, can be adjusted such that during heating of the pouring discharge 9 and/or of the outflowing remainder of the melt, the latter does not freeze. The pouring discharge 9 can also be provided with an inner layer which is more wear-resistant with respect to the melt than the material of the pouring discharge. In the region of the melt entry and/or the melt exit the pouring discharge 9 can be widened in the form of a diffusor or conically to improve the flow.

In another embodiment in which the pouring discharge 9 itself is not coupled to the electromagnetic field of inductor 4, for heating the pouring discharge 9 a susceptor can be provided which is heated inductively by inductor 4. Such susceptor can, for example, be disposed between the intermediate sleeve 6 and the pouring discharge 9 or also be a component of the pouring discharge 9 in the form of another jacket (not shown). Such susceptor subsequently transfers indirectly the heat for splashing by thermal conduction and/or heat radiation to the pouring discharge 9.

Figure 3:
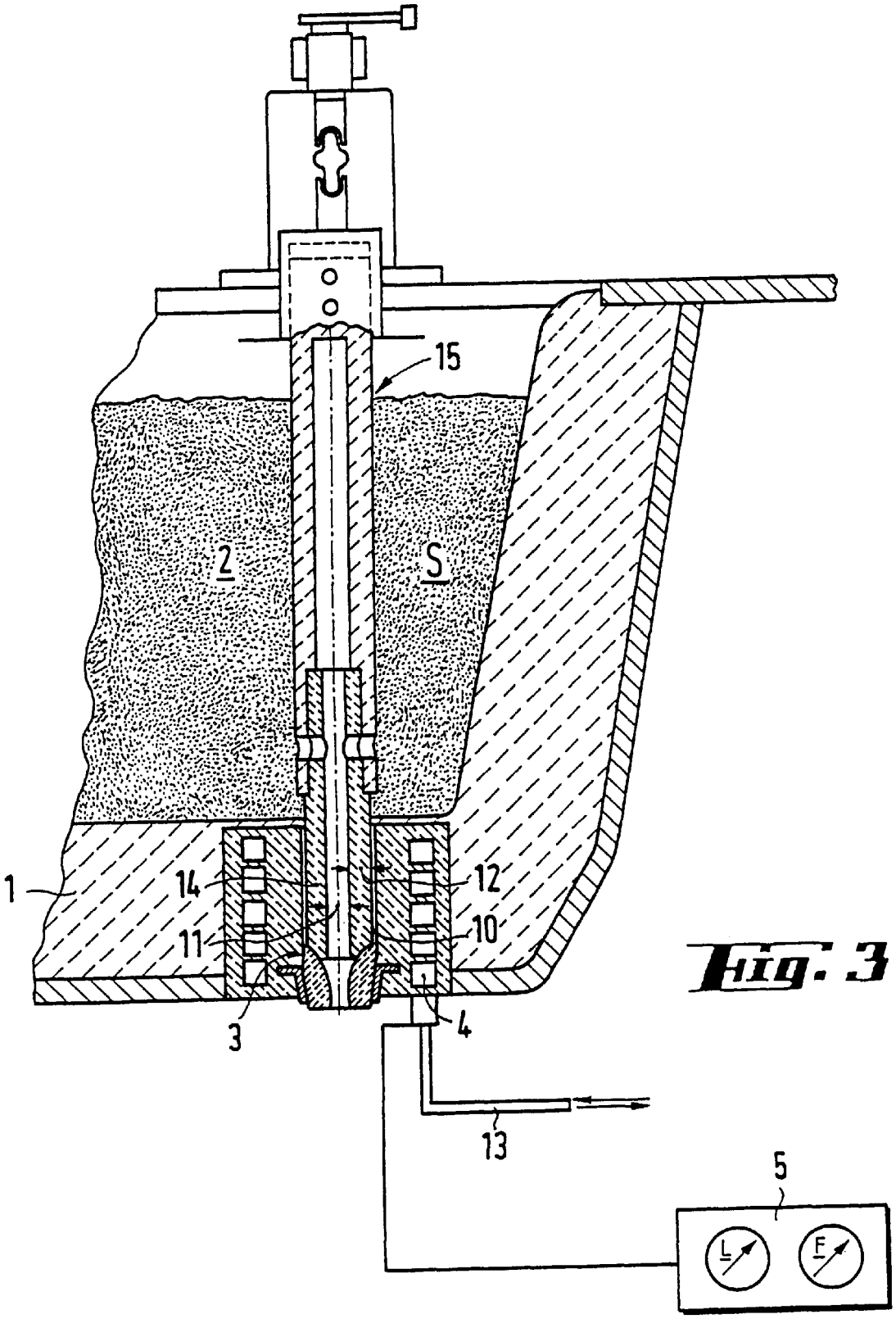
FIG. 3 is a sectional view of a pipe-in-pipe closing system with an inductively heated stator in the bottom of a melt vessel.

FIG. 3 shows an example of a further embodiment of the invention, in which at the side of outflow of the melt is provided a control element, known per se, for example a pipe-in-pipe closing system 15. In this case the pouring discharge is in the form of a stator 14 and can be disposed in the bottom of the metallurgical vessel such that the melt flows out vertically. It is also possible that the discharge or the stator 14 is realized in the form of an immersion discharge, and thus comprises an extension downwardly into the chill (not shown). Before splashing, the control element is closed and the stator 14 is heated by means of inductor 4 to a temperature at which the melt in the discharge cannot freeze during splashing. After melt has been filled into the vessel, the control element is opened so that the melt, without freezing in the discharge, flows out. Following the filling of the vessel and after opening of the pipe-in-pipe closing system 15, the electric power and/or frequency of inductor 4 can be adjusted such that the electromagnetic field of inductor 4 is not only coupled to the discharge but also to the melt so that the latter is kept in a flowable state before the melt flows out. This is also, and in particular, of advantage for the splashing of a gate-valve closure, know per se, in which, before the vessel is filled, the melt arrives in the outflow up to a closing plate and freezes there if special measures, such as sand filling, are not taken. If, in contrast, according to the invention, the melt in the discharge is kept liquid, sand filling or the like can be omitted. Also, during teeming in the stator 14, the steel can be agitated as well as also be heated electromagnetically which permits low teeming temperatures.

What is claimed is:

1. A process for splashing and teeming molten metal through a discharge in a wall or a bottom of a metallurgical vessel, said process comprising:

before and during said splashing and during said teeming of said molten metal through said discharge, electromagnetically coupling said discharge to an electromagnetic field of at least one inductor that is at least to some extent disposed in said wall or said bottom of the metallurgical vessel, while at least partially air-cooling said at least one inductor;

during said splashing, adjusting at least the frequency of said at least one inductor such that said electromagnetic field penetrates substantially the wall thickness of said discharge; and during said teeming, adjusting at least the frequency of said at least one inductor such that said electromagnetic field penetrates beyond said wall thickness of said discharge and into said molten metal flowing through said discharge.

2. A process as claimed in claim 1, wherein said frequency during said splashing is adjusted to 2 kHz to 10 kHz.

3. A process as claimed in claim 1, wherein said frequency during said splashing is adjusted to 4 kHz to 10 kHz.

4. A process as claimed in claim 1, wherein said adjusting during said splashing comprises also adjusting the power of said at least one inductor.

5. A process as claimed in claim 4, wherein said power during said splashing is adjusted to 5 kW to 150 kW.

6. A process as claimed in claim 4, wherein said power during said splashing is adjusted to 20 kW to 60 kW.

7. A process as claimed in claim 1, wherein said frequency during said teeming is adjusted to 6 kHz to 10 kHz.

8. A process as claimed in claim 1, further comprising, during said teeming, electromagnetically coupling said molten metal to a further electromagnetic field.

9. A process as claimed in claim 8, further comprising adjusting the frequency of said further electromagnetic field to 3 Hz to 4000 Hz.

10. A process as claimed in claim 8, further comprising adjusting the frequency of said further electromagnetic field to 500 Hz to 3000 Hz.

11. A process as claimed in claim 1, wherein said adjusting during said teeming comprises also adjusting the power of said at least one inductor.

12. A process as claimed in claim 11, wherein said power during said teeming is adjusted to 3 kW to 120 kW.

13. A process as claimed in claim 11, wherein said power during said teeming is adjusted to 5 kW to 40 kW.

14. A process as claimed in claim 11, wherein said power is adjusted to be higher during said splashing than during said teeming.

15. A process as claimed in claim 1, comprising entirely air cooling said at least one inductor during said splashing and said teeming.

16. A process as claimed in claim 1, comprising conducting said teeming at plural independent frequencies.

17. A process as claimed in claim 1, comprising conducting said teeming at plural independent electric powers.

18. A process as claimed in claim 1, further comprising, during said teeming, coupling at least one spatially variable electromagnetic field to said molten metal flowing through said discharge.

19. A process as claimed in claim 1, wherein outflow of said molten metal from said discharge is controlled by a closing system, and further comprising, prior to filling of said molten metal into said metallurgical vessel, operating said closing system to close said discharge, and said electromagnetically coupling comprises heating said discharge to a temperature sufficient to, upon subsequent filling of said molten metal into said metallurgical vessel and operating said closing system to open said discharge, prevent said molten metal from freezing in said discharge.

20. A process as claimed in claim 19, further comprising, upon said operating said closing system to open said discharge, electromagnetically coupling said molten metal flowing through said discharge to an electromagnetic field.

21. A process for splashing and teeming molten metal through a discharge in a wall or a bottom of a metallurgical vessel, said process comprising:

before and during said splashing and during said teeming of said molten metal through said discharge, electromagnetically coupling said discharge to an electromagnetic field of at least one inductor that is at least to some extent disposed in said wall or said bottom of the metallurgical vessel, while at least partially air-cooling said at least one inductor; and conducting said teeming at plural independent frequencies and/or plural independent electric powers.

22. A process as claimed in claim 21, comprising adjusting a frequency of said inductor during said splashing to 2 kHz to 10 kHz.

23. A process as claimed in claim 21, comprising adjusting a frequency of said inductor during said splashing to 4 kHz to 10 kHz.

24. A process as claimed in claim 21, comprising adjusting a power of said inductor during said splashing.

25. A process as claimed in claim 24, wherein said power during said splashing is adjusted to 5 kW to 150 kW.

26. A process as claimed in claim 24, wherein said power during said splashing is adjusted to 20 kW to 60 kW.

27. A process as claimed in claim 21, comprising adjusting a frequency of said inductor during said teeming to 6 kHz to 10 kHz.

28. A process as claimed in claim 21, comprising, during said teeming, electromagnetically coupling said molten metal to a further electromagnetic field.

29. A process as claimed in claim 28, further comprising adjusting the frequency of said further electromagnetic field to 3 Hz to 4000 Hz.

30. A process as claimed in claim 28, further comprising adjusting the frequency of said further electromagnetic field to 500 Hz to 3000 Hz.

31. A process as claimed in claim 21, comprising, during said teeming, adjusting said electric power of said at least one inductor.

32. A process as claimed in claim 31, wherein said power during said teeming is adjusted to 3 kW to 120 kW.

33. A process as claimed in claim 31, wherein said power during said teeming is adjusted to 5 kW to 40 kW.

34. A process as claimed in claim 31, wherein said power is adjusted to be higher during said splashing than during said teeming.

35. A process as claimed in claim 21, comprising entirely air cooling said at least one inductor during said splashing and said teeming.

36. A process as claimed in claim 21, comprising conducting said teeming at plural independent frequencies.

37. A process as claimed in claim 21, comprising conducting said teeming at plural independent electric powers.

38. A process as claimed in claim 21, further comprising, during said teeming, coupling at least one spatially variable electromagnetic field to said molten metal flowing through said discharge.

39. A process as claimed in claim 21, wherein outflow of said molten metal from said discharge is controlled by a closing system, and further comprising, prior to filling of said molten metal into said metallurgical vessel, operating said closing system to close said discharge, and said electromagnetically coupling comprises heating said discharge to a temperature sufficient to, upon subsequent filling of said molten metal into said metallurgical vessel and operating said closing system to open said discharge, prevent said molten metal from freezing in said discharge.

40. A process as claimed in claim 39, further comprising, upon said operating said closing system to open said discharge, electromagnetically coupling said molten metal flowing through said discharge to an electromagnetic field.

41. An arrangement for splashing and teeming molten metal, said arrangement comprising:

a metallurgical vessel for containing molten metal;

a discharge, disposed in a wall or a bottom of said metallurgical vessel, for splashing and teeming molten metal therefrom;

a first inductor, disposed at least to some extent in said wall or said bottom of said metallurgical vessel, for generating a spatially variable first electromagnetic field to be coupled to molten metal in said discharge;

a second inductor, disposed at least to some extent in said wall or said bottom of said metallurgical vessel, for generating a second electromagnetic field, independent of said first electromagnetic field, to be coupled to said discharge to heat said discharge and to maintain heated said discharge and molten metal therein;

said first and second inductors being operable independently at respective frequencies and electric powers; and at least one of said inductors being at least partially air-cooled.

42. An arrangement as claimed in claim 41, wherein said at least one of said inductors is entirely air-cooled.

43. An arrangement as claimed in claim 41, wherein both said first and said second inductors are at least partially air-cooled.

44. An arrangement as claimed in claim 41, wherein said first and second inductors are entirely air-cooled.

45. An arrangement as claimed in claim 41, wherein said discharge comprises a refractory sleeve.

46. An arrangement as claimed in claim 45, wherein at least one of said inductors is embedded in said sleeve.

47. An arrangement as claimed in claim 45, wherein both of said first and said second inductors are embedded in said sleeve.

48. An arrangement as claimed in claim 45, wherein said sleeve is widened in at least one of an inflow region and an outflow region thereof.

49. An arrangement as claimed in claim 45, wherein said sleeve has applied to an inner surface thereof a layer of wear resistant material.

50. An arrangement as claimed in claim 41, further comprising respective converters electrically connected to said inductors for adjusting said respective frequencies and electric powers.

51. An arrangement as claimed in claim 41, further comprising a closing system for opening and closing a passage through said discharge.

52. A refractory discharge to be disposed in a wall or a bottom of a metallurgical vessel for splashing and teeming molten metal from said metallurgical vessel, said discharge comprising:

a flowthrough passage through said discharge;

a first inductor, to be disposed at least to some extent in the wall or the bottom of the metallurgical vessel, for generating a spatially variable first electromagnetic field to be coupled to molten metal in said discharge;

a second inductor, to be disposed at least to some extent in the wall or the bottom of the metallurgical vessel, for generating a second electromagnetic field, independent of said first electromagnetic field, to be coupled to said discharge to heat said discharge and to maintain heated said discharge and molten metal therein;

said first and second inductors being operable independently at respective frequencies and electric powers; and at least one of said inductors being at least partially air-cooled.

53. A discharge as claimed in claim 52, said at least one of said inductors is entirely air-cooled.

54. A discharge as claimed in claim 52, wherein both said first and said second inductors are at least partially air-cooled.

55. A discharge as claimed in claim 52, wherein said first and second inductors are entirely air-cooled.

56. A discharge as claimed in claim 52, comprising a refractory sleeve.

57. A discharge as claimed in claim 56, wherein at least one of said inductors is embedded in said sleeve.

58. A discharge as claimed in claim 56, wherein both of said first and said second inductors are embedded in said sleeve.

59. A discharge as claimed in claim 56, wherein said sleeve is widened in at least one of an inflow region and an outflow region thereof.

60. A discharge as claimed in claim 56, wherein said sleeve has applied to an inner surface thereof a layer of wear resistant material.

61. A discharge as claimed in claim 52, further comprising respective converters electrically connected to said inductors for adjusting said respective frequencies and electric powers.

* * * * *